US005492322A

United States Patent [19]

Smith

[11] Patent Number: 5,492,322

[45] Date of Patent: Feb. 20, 1996

[54] GREEN READER DEVICE

[76] Inventor: Glenn E. Smith, 4872 Pacemont Ave., Dayton, Ohio 45415

[21] Appl. No.: 369,368

[22] Filed: Jan. 6, 1995

[51] Int. Cl.[6] ..... A63B 57/00; G01C 9/24

[52] U.S. Cl. ..... 273/32 B; 33/379; 33/389; 273/32 H

[58] Field of Search ..... 273/32 H, 32 R, 273/32 A, 32 B, 32 D, 162 B, 162 F, 187.6, 163 R, 163 A, 164.1; 33/379, 389, 390, 424, 425, 426, 365, 377

[56] References Cited

U.S. PATENT DOCUMENTS

| | | | |
|---|---|---|---|
| 824,109 | 6/1906 | Gibson | 33/389 |
| 2,584,917 | 2/1952 | Powell | 33/377 |
| 3,568,325 | 3/1971 | Baltz | 33/377 X |
| 4,854,579 | 8/1989 | Baxter | 273/32 H |
| 4,864,854 | 9/1989 | Van Leemput | 273/32 H X |
| 4,880,232 | 11/1989 | Lang | 273/32 B |
| 5,135,220 | 8/1992 | Baldoni | 273/32 H X |
| 5,211,400 | 5/1993 | Hall et al. | 273/187.6 |
| 5,298,904 | 3/1994 | Olich | 342/42 |

*Primary Examiner*—William H. Grieb

[57] ABSTRACT

A green reader device including a clear body having a horizontal line and a vertical line formed thereon and a bubble level affixed to the body. The horizontal line and the vertical line extend in intersecting relationship. The bubble level serves to indicate a horizontal orientation of the horizontal line. The body has angular indices adjacent the horizontal line and angular markings adjacent the vertical line. The angular indices and angular markings are offset from the horizontal line and the vertical line at uniform increments. The body has a generally rectangular configuration. The bubble level is affixed along a top edge of the body.

16 Claims, 3 Drawing Sheets

GREEN READER DEVICE

TECHNICAL FIELD

The present invention relates to devices for improving one's golf game. More particularly, the present invention relates to devices for detecting an orientation of a green. More particularly, the present invention relates to devices for facilitating one's understanding of the layout of a golf course.

BACKGROUND ART

The ability to properly determine the orientation of a golf course is important to the improvement of one's golfing game. It is important to accurately assess whether a distant target lies at an angle or in a horizontal plane. Adjustments in swing are necessary to accommodate various angular orientations of the putting green. For example, if the putting green extends downwardly from an edge, then it would be desirable to aim the golf ball toward the higher side of the green. This would allow the ball to roll downwardly toward the pin.

Unfortunately, it is often difficult to accurately determine whether the green is in a horizontal plane or if it lies at an angle. The inability to properly determine the orientation of the green can be caused by the poor Judgment of the golfer or by the orientation of the land upon which the golfer is standing. As such, it is desirable to have an independent means for accurately determining the angular planar orientation of the golfing green.

In the past, various devices have been developed so as to facilitate the ability to gain proper judgment on the golf course. Unfortunately, these items are often bulky and difficult to transport. It is very important that any orientation device be small enough to be easily carried, easily used, and easily stowed.

In the past, various patents have issued relating to golfing devices for improving the golfer's assessment of the golf course. For example, U.S. Pat. No. 4,854,579, issued on Aug. 8, 1989, to G. M. Baxter teaches a wind indicator for use by a golfer. This wind indicator includes a vane movably mounted on a base for indicating wind direction. A propeller is rotatably mounted with the vane and carries observable indicia which vary in appearance in accordance with the speed of the propeller and the wind velocity.

U.S. Pat. No. 4,864,854, issued on Sep. 12, 1989, to R. van Leemput describes a golfer's wind indicator and club suggestion assistance device. This device includes a means for indicating wind direction relative to the desired line of flight of the golf ball. A means is also provided for measuring wind velocity and provided with precalibrated indicia awaiting to the measured wind velocity to the number of numerical club designations by which the golfer should increase or decrease the club number which would normally be selected under windless conditions.

U.S. Pat. No. 4,880,232, issued on Nov. 14, 1989, to J. P. Lang teaches a flag pin golf ball distance measuring device that includes an elongated cylindrical pin having a lower end provided with a radially extending flange and dimensioned for registry with a standard golf hole club. A free end of a measuring tape is secured to a sleeve around the elongated cylindrical pin. A cardholder is attached to the pin adjacent the handle and includes a holder for a writing instrument.

U.S. Pat. No. 5,135,220, issued on Aug. 4, 1992, to L. Baldoni describes a golf ball position marker apparatus. A wind indicator vane is mounted hingedly within the housing so as to provide a visual indication of wind direction to assist a golfer in club selection and angle of attack in a golfing game.

U.S. Pat. No. 5.,211,400, issued on May 18, 1993, to Hall et al. describes a golf putting aid having a rotatable horizontal sighting ring at the upper end of a vertical support post. A ball/club path marker extends thereacross and outwardly therefrom. A clubhead alignment marker extends transversely across the sight ring to form a cross hair sight at the center of the ring. A smaller ball sight ring approximately the same diameter as a golf ball is disposed within the larger sighting ring at one side of the club head alignment marker. In use, the larger sighting ring is positioned such that when viewed by a golfer in a standing position, the smaller ball sight ring is superposed over the golf ball and the ball/club path marker is aligned with the desired ball path and the club head alignment marker will be perpendicular to the desired golf ball path.

U.S. Pat. No. 5,298,904, issued on Mar. 29, 1994, to K. G. Olich provides a distance measuring system that can be used on a golf course in order for the golfer to accurately measure the distance between the present lie of the golf ball and the hole toward which the golfer is currently advancing the golf ball. This system includes several receivers and transmitters that provide electronic signals for detecting such distances.

It is an object of the present invention to provide a green reader that assists the golfer in determining the angular orientation of the putting.

It is another object of the present invention to provide a green reader that is accurate despite the angular orientation of the surface upon which the golfer is standing.

It is another object of the present invention to provide a green reader that is easy to use, easy to manufacture, and relatively inexpensive.

It is a further object of the present invention to provide a green reader that can be easily stowed within a golfer's pocket.

These and other objects and advantages of the present invention will become apparent from a reading of the attached specification and appended claims.

SUMMARY OF THE INVENTION

The present invention is a green reader device that comprises a Generally clear body having a horizontal line and a vertical line formed thereon and a bubble level affixed to the body. The horizontal line and the vertical line extend in intersecting relationship. The bubble level serves to indicate a horizontal orientation of the horizontal line.

The body has angular indices adjacent the horizontal line. These angular indices are radially offset from the horizontal line at uniform increments. Typically, these uniform increments will be five degree increments. The body also has angular markings adjacent the vertical line. These angular markings are radially offset from the vertical line at uniform increments.

The body has a Generally rectangular configuration. The bubble level is affixed at an edge of the body. The bubble level is affixed centrally along a top edge of the body. In particular, the bubble level can be positioned within a slot formed along the top edge of the body such that the top edge of the bubble level is in alignment with the top edge of the body.

The body has a flat facing surface. The horizontal line and the vertical line are either etched or printed onto the flat facing surface. The horizontal line centrally intersects the vertical line. The horizontal line and the vertical line have similar lengths. The body has a height and a width of less than four inches. The bubble level includes a marking thereon for indicating a true horizontal orientation of the horizontal line.

In an alternative embodiment, the bottom edge has a thumb hold extending outwardly therefrom so as to facilitate the gripping and positioning of the body. An imprint area can be placed on the body adjacent the bottom edge so as to receive advertisement and message information thereon.

DETAILED DESCRIPTION OF THE INVENTION

Figure 1:
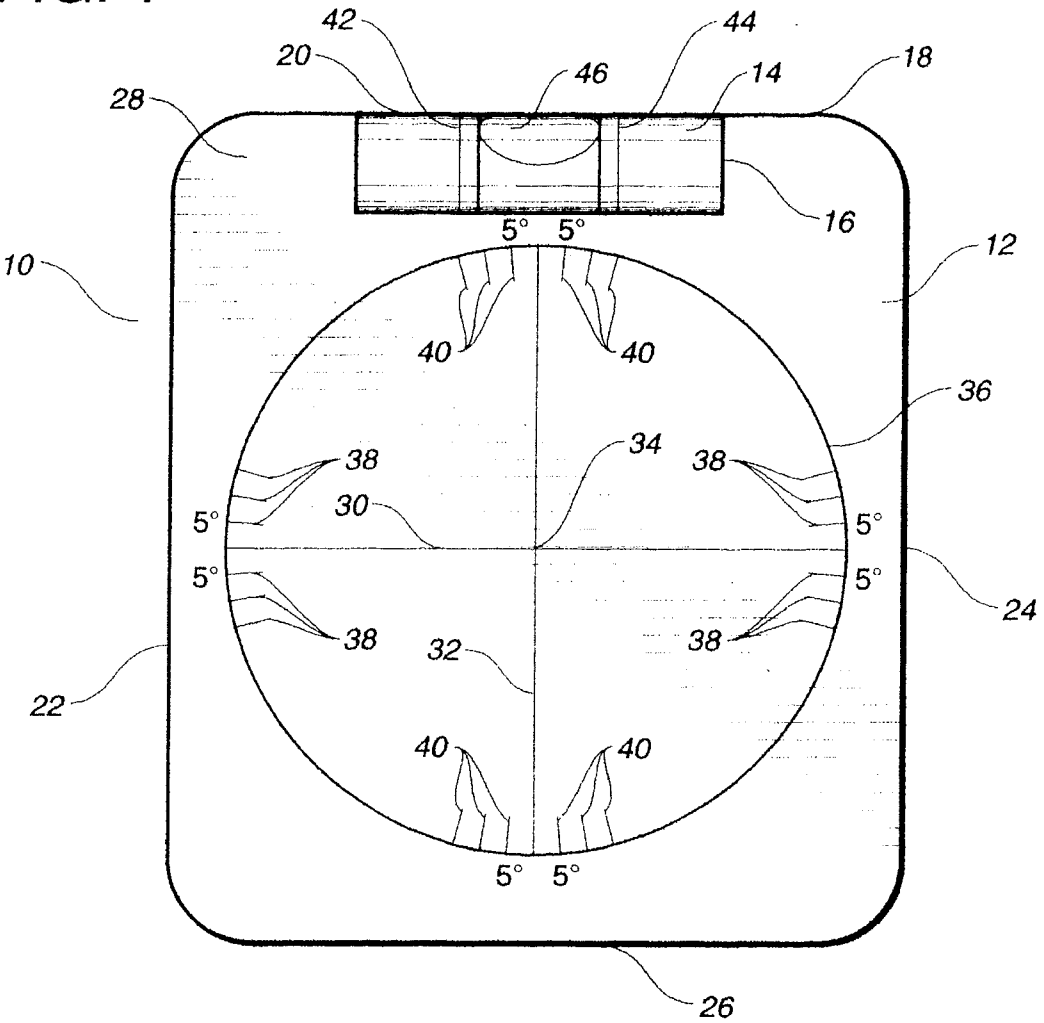
FIG. 1 is a front elevational view of the green reader device in accordance with the preferred embodiment of the present invention.

Referring to FIG. 1, there is shown at 10 the green reader device in accordance with the preferred embodiment of the present invention. The green reader device 10 includes a generally clear body 12 and a bubble level 14. The bubble level 14 is affixed centrally within a slot 16 formed into the top edge 18 of the body 12. The top edge 20 of the bubble level 14 is aligned with the top edge 18 of the body 12.

The body 12 has a generally rectangular configuration. Specifically, the body 12 includes side edges 22 and 24, top edge 18, and bottom edge 26. The body 12 has a flat facing surface 28. In the preferred embodiment of the present invention, the distance between the sides 22 and 24 is less than three inches. Similarly, the distance between the top edge 18 and the bottom edge 26 is less than four inches. The body 12 is made of a clear plastic material.

Importantly, the size of the body 12 facilitates the ability of the green reader 10 to be stowed within a golfer's pocket. If necessary, the green reader 10 can be provided with a pouch that can be attached to a belt loop for the golfer's convenience. The small size of the green reader 10 facilitates its use and encourages the golfer to have the green reader in a convenient location. The size of the green reader 10 eliminates the problems associated with bulky electronic devices for the sensing of the orientation of the layout of a golf course.

The flat face 28 of the body 12 has a horizontal line 30 and a vertical line 32. Lines 30 and 32 can be printed, silk screened, or etched into the face 28 of the body 12. The horizontal line 30 intersects the vertical line 32 at a center point 34. The horizontal line 30 and the vertical line 32 have similar lengths. A circle 36 is also formed on the face 28 so as to surround the vertical line 32 and the horizontal line 30. The circle 36 provides the golfer with a visual cue as to the angular orientation of the distant surface.

The horizontal line 30 has a plurality of angular indices 38 adjacent to the horizontal line 30. These angular indices 38 are radially offset from the horizontal line 30 at uniform increments. In the preferred embodiment of the present invention, these uniform increments are five degree increments.

The vertical line 32 also has angular markings adjacent thereto. These angular markings 40 are radially offset from the vertical line 32 at uniform increments. As with the indices 38, the markings 40 are provided at uniform increments of five degrees. As can be seen, the indices 38 and the markings 40 extend inwardly from the circle 36.

The bubble level 14 includes markings 42 and 44 that indicate the true horizontal orientation of the horizontal line 30. It is important that the horizontal line 30 be aligned in parallel relationship to the bubble level 14 in order to provide this true horizontal orientation. Whenever the bubble 46 is positioned between the markings 42 and 44, the golfer will know that the horizontal line 30 is in a proper horizontal orientation and that the vertical line is truly vertical.

It can be seen in the present invention that the bubble level 14 is received within a slot 16 formed along the top edge 18 of the body 12. As such, the top edge 20 of the bubble level 14 will align itself with the top edge 18 of the body 12. This will provide a golfer with a truer display of the horizontal orientation of the bubble level 14. If the top edge 20 of the bubble level 14 were not aligned with the top edge 18 of the body 12, then a slight optical effect would result which would tend to distort the golfer's view of the orientation of the green. Such an arrangement would also make it more difficult for the golfer to view the orientation of the bubble 46 while also peering through the interior of the circle 36.

It is also important to note that the bubble level 14 is positioned adjacent to the top edge 18. Within the concept of the present invention, the bubble level 14 could also be placed at the bottom edge 26. However, it is preferable that the bubble level 14 be placed adjacent to the top edge 18 since the use of the device 10 will be easier by looking up at the bubble level 14, rather than looking down at the bubble level (if it were placed at the bottom edge 26).

Figure 2:
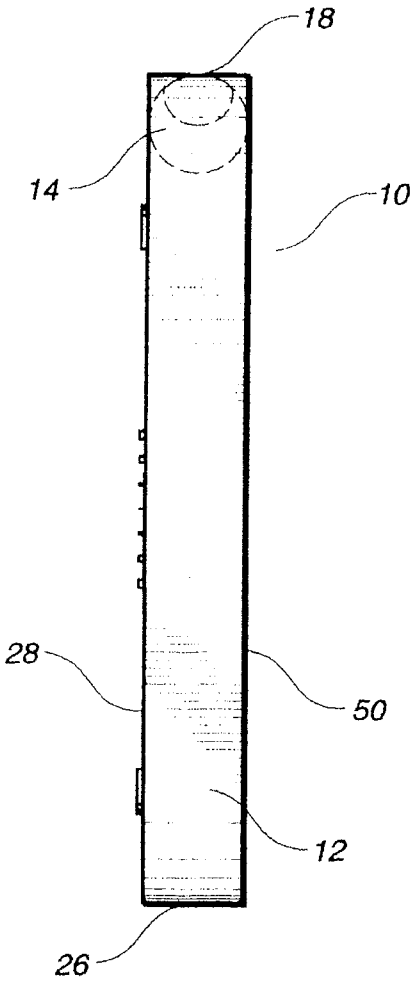
FIG. 2 is a side elevational view of the green reader device in accordance with the preferred embodiment of the present invention.

FIG. 2 shows the device 10 from the side view. As can be seen from the side, the device 10 has a relatively narrow thickness (approximately one-quarter inch) between the front facing surface 28 and the back surface 50. The bubble level 14 is positioned generally centrally between the front surface 28 and the bottom surface 50. Because of the narrow thickness of the device 10, the device 10 can easily be stowed in a shirt pocket.

Figure 3:
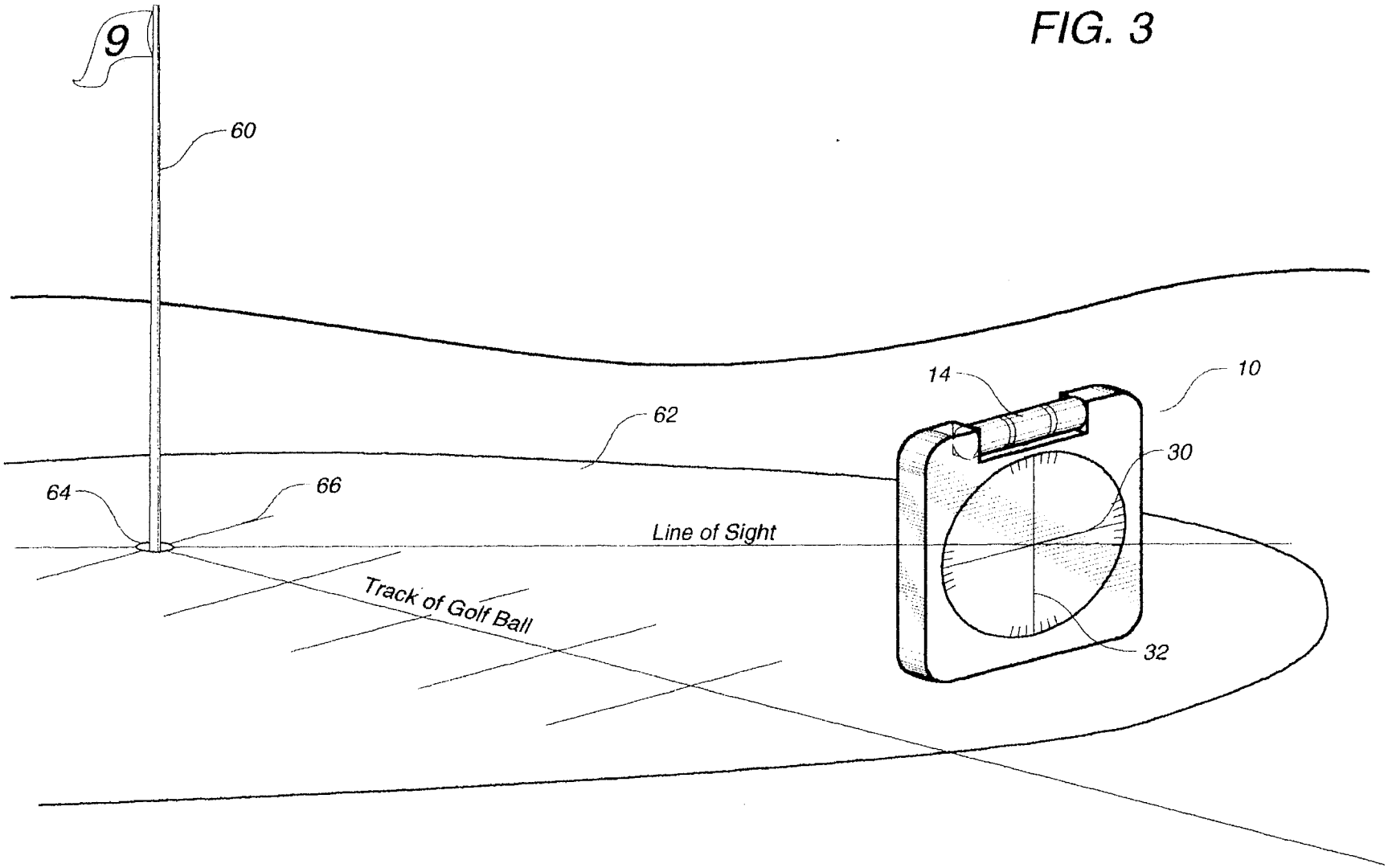
FIG. 3 shows the use of the green reader device of the present invention for sensing the planar orientation of a golfing green.

FIG. 3 shows the use of the device 10. Initially, the device 10 is held in the hand and oriented to the pin 60 on a green 62. The pin 60 is positioned within the hole 64. Initially, the golfer views through the device 10 so as to line up the vertical line 32 with the pin 60. The intersection of the horizontal line 30 and the vertical line 32 can be positioned so as to be aligned with the hole 64 on the green 62. The bubble level 14 should then be centered such that the bubble 46 resides between the markings 42 and 44. Once the device 10 is properly aligned, the golfer can see whether the hole is sitting in a horizontal plane and whether the path to the hole is level or not. The markings and indices adjacent the horizontal line 30 and the vertical line 32 facilitate the ability of the golfer to know how many degrees the approach is off or the hole is off. The golfer can then learn to compensate for this slant so as to properly aim for the hole 64.

As can be seen in FIG. 3, a first line 66 extends in transverse orientation to the vertical orientation to the pin 60. The horizontal line 32 of the device 10 can be used so as to tell the slope of the first line 66. The first line 66 can also be any point on the green. This point can always be viewed and marked so as to be compared to the orientation of the horizontal line 30.

Figure 4:
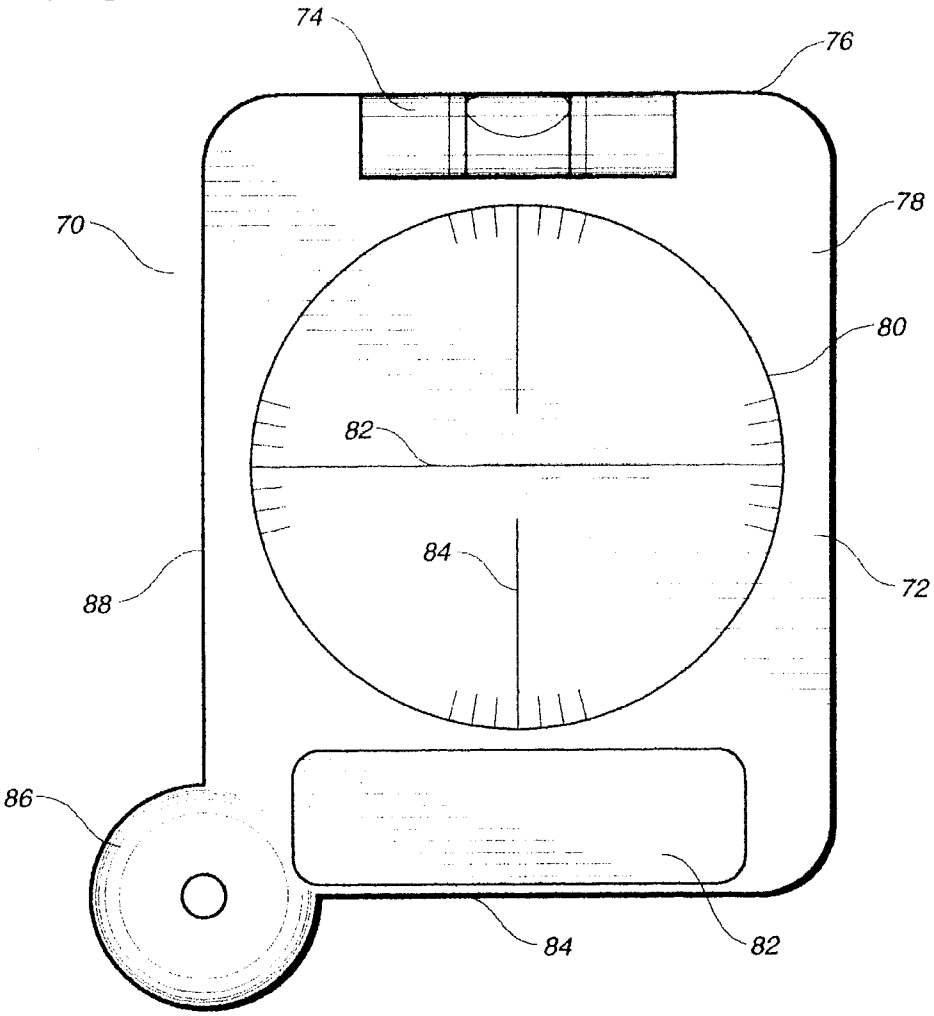
FIG. 4 is a frontal view of an alternative embodiment of the present invention.

FIG. 4 shows an alternative embodiment 70 of the green reader device of the present invention. It can be seen that the device 70 includes a body 72 having a bubble level 74 along an upper edge 76. The face 78 of device 70 includes a circular area 80 having a horizontal line 82 and a vertical line 84. It can be seen in FIG. 5 that the horizontal and vertical lines do not directly intersect. However, the term "intersecting" is used herein (and in the claims) should include such an arrangement in which either the horizontal or vertical line is segmented such that the line formed by the segments would intersect the other line.

In FIG. 4, it can be seen that an imprint area 82 is formed on the face 78 adjacent to the bottom edge 84 of the body 72. The imprint area 82 is suitable for receiving advertising or message information thereon. A thumb hold 86 is formed in the body 72 so as to extend outwardly from the bottom edge 82 and from a side edge 88. The thumb hold 86 facilitates the ability of the user to properly position the device 70.

Figure 5:
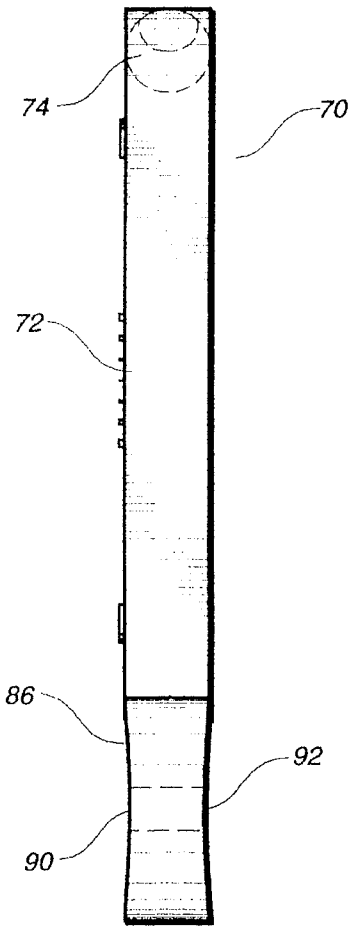
FIG. 5 is a side view of the alternative embodiment of FIG. 4.

FIG. 5 shows the device 70 as having a relatively thin depth. It can be seen that the thumb hold 86 has a concave front surface 90 and a concave back surface 92. The thumb hold 86 extends upwardly to the body 72. The body 72 has a thickness of approximately ⅜ inches.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A green reader device comprising:

a generally clear body having a horizontal line and a vertical line formed thereon, said horizontal line and said vertical line extending in intersecting relationship; and a bubble level means affixed to said body, said bubble level means for indicating a horizontal orientation of said horizontal line, said body having a generally rectangular configuration, said bubble level means affixed to an edge of said body, said bubble level means affixed centrally along a top edge of said body, said body having a thumb hold formed along a bottom edge of said body, said thumb hold having concave surfaces on a front side and a back side of said thumb hold.

2. The device of claim 1, said body having angular indices adjacent said horizontal line.

3. The device of claim 2, said angular indices radially offset from said horizontal line at uniform increments.

4. The device of claim 3, said uniform increments being five degree increments.

5. The device of claim 2, said body having angular marking adjacent said vertical line.

6. The device of claim 5, said angular markings radially offset from said vertical line at uniform increments.

7. The device of claim 6, said uniform increments being five degree increments.

8. The device of claim 1, said horizontal line centrally intersecting said vertical line, said horizontal line and said vertical line having similar lengths.

9. The device of claim 1, said body having a flat facing surface, said horizontal line and said vertical line being etched into said flat facing surface.

10. The device of claim 1, said body having a height and a width of less than four inches.

11. The device of claim 1, said body having a flat facing surface, said horizontal line and said vertical line being printed onto said flat facing surface, said body having an imprint area adjacent a bottom edge.

12. The device of claim 1, said bubble level means comprising a bubble level affixed within a slot formed centrally along a top edge of said body, said bubble level having a top edge aligned with said top edge of said body, said bubble level means having a marking thereon for indicating a true horizontal orientation of said horizontal line.

13. A green reader device comprising:

a generally clear body having a horizontal line and a vertical line formed thereon, said horizontal line and said vertical line intersecting each other centrally, said body having angular indices adjacent said horizontal line, said body having angular markings adjacent said vertical line; and a bubble level affixed to an edge of said body, said bubble level having a marking showing a true horizontal orientation of said horizontal line, said bubble level affixed within a slot formed along said edge of said body, said edge being a top edge of said body, said bubble level having a top edge aligned with said top edge of said body, said body having a bottom edge with a thumb hold extending outwardly therefrom.

14. The device of claim 13, said angular indices radially offset from said horizontal line at uniform increments, said angular markings radially offset from said vertical line at uniform increments.

15. The device of claim 14, said uniform increments being five degree increments.

16. The device of claim 13, said body having a circle formed thereon, said circle surrounding said vertical line and said horizontal line, said angular indices and said angular markings extending inwardly from said circle.

* * * * *